US007432431B2

(12) United States Patent
Hirota et al.

(10) Patent No.: US 7,432,431 B2
(45) Date of Patent: Oct. 7, 2008

(54) SPEED DETECTING APPARATUS FOR KEYBOARD MUSICAL INSTRUMENT

(75) Inventors: Kenichi Hirota, Shizuoka-ken (JP); Tetsuya Hirano, Shizuoka-ken (JP)

(73) Assignee: Kabushiki Kaisha Kawai Gakki Seisakusho, Shizuoka-ken (JP)

( * ) Notice: Subject to any disclaimer, the term of this patent is extended or adjusted under 35 U.S.C. 154(b) by 0 days.

(21) Appl. No.: 11/339,773

(22) Filed: Jan. 25, 2006

(65) Prior Publication Data

US 2006/0185497 A1 Aug. 24, 2006

(30) Foreign Application Priority Data

Jan. 26, 2005 (JP) ..... 2005-018956

(51) Int. Cl.
*G10G 3/04* (2006.01)
*G10H 3/22* (2006.01)
*G10H 3/06* (2006.01)

(52) U.S. Cl. ..... 84/462; 84/724

(58) Field of Classification Search ..... 84/21, 84/23, 236, 434, 435, 439, 461, 462, 687, 84/719, 724
See application file for complete search history.

(56) References Cited

U.S. PATENT DOCUMENTS 5,012,715 A * 5/1991 Matsunaga et al. ..... 84/724
5,237,123 A * 8/1993 Miller ..... 84/21

FOREIGN PATENT DOCUMENTS

JP 02-160292 6/1990
JP 09-068981 3/1997

* cited by examiner

*Primary Examiner*—Lincoln Donovan
*Assistant Examiner*—Andrew R Millikin
(74) *Attorney, Agent, or Firm*—Crowell & Moring LLP

(57) ABSTRACT

A speed detecting apparatus for a keyboard musical instrument is provided for accurately detecting the speed of bivotal movements of a hammer and a key even if a shutter implies errors in its attachment, without affected by such errors. The speed detecting apparatus for a keyboard musical instrument comprises a pivotable key, a hammer pivotably supported by a fulcrum and configured to pivotally move in association with a pivotal movement of the key, a shutter integrally attached to the hammer, a plurality of detectors, each having a light emitter and a light receiver for receiving light emitted from the light emitter, arranged on one and the other sides of the pivotal movement path of the shutter, and a CPU for detecting a pivot speed of the hammer in response to timings at which the shutter opens and closes the light paths of the light of the plurality of detectors when the hammer pivotally moves. The plurality of detectors have detection points on respective light paths of the light from the light emitters, and are arranged such that the detection points are positioned on an arc centered at the fulcrum of the hammer.

6 Claims, 13 Drawing Sheets

PRIOR ART

PRIOR ART

PRIOR ART

SPEED DETECTING APPARATUS FOR KEYBOARD MUSICAL INSTRUMENT

BACKGROUND OF THE INVENTION

1. Field of the Invention

The present invention relates to a speed detecting apparatus which is applied, for example, to an electronic keyboard musical instrument such as an electronic piano, and a composite piano such as a silent piano and an automatically playing piano for detecting the speed of pivotal movements of a key or a hammer.

2. Description of the Prior Art

Generally, when an electronic piano is played or when a silent piano is played in silence, a detection is generally made for a speed at which a key or a hammer pivotally moves in association with a touch on the key, a velocity is determined based on the detected pivot speed, and a volume to be generated is determined based on the determined velocity. This is because the volume of an acoustic piano and the like is determined in accordance with a speed at which a key is touched, a speed at which a hammer strikes a string, and the like.

In the past, Laid-open Japanese Patent Application No. 02-160292, for example, discloses a speed detecting apparatus for detecting a pivot speed of a hammer. As illustrated in FIG. 1, the disclosed speed detecting apparatus 61 comprises a pivotable key (not shown), a hammer 63 pivotably supported by a center pin 68 to pivotally move in association with a touch on the key to strike a string 62, a shutter 64 arranged on the hammer 63, a first to a third sensor 65, 66, 67, and the like. The shutter 64 is formed in a planar fan shape, and is fixed to a catch shank 63*a* of the hammer 63. The first to third sensors 65-67 are arranged in a straight line with certain intervals defined therebetween. Each of the first to third sensors 65-67 comprises a pair of a light emitter and a light receiver (none of which is shown), and is configured such that light emitted from the light emitter is received by the light receiver. These light emitters and light receivers are arranged on both sides of a shutter moving path, and in a key releasing state (the components are positioned as indicated by solid lines in FIG. 1), the shutter 64 does not overlap with any sensor, but is positioned nearby.

In the structure as described above, a touch on the key causes the hammer 63 to pivotally move about the center pin 68 in the counter-clockwise direction in FIG. 1, associated with the touch. This pivotal movement of the hammer 63 causes the shutter 64 to sequentially block the light from the first to third sensors 65-67, so that the first to third sensors 65-67 generate detection signals in response to the blocking of light emitted therefrom. Among these detection signals, the detection signal from the first sensor 65 is used to detect positional information on the key, while the detection signals from the second and third sensors 66, 67 are used to detect the pivot speed of the hammer 63. Specifically, a time required for the shutter 64 to move between the second sensor 66 and the third sensor 67 is detected based on the timings at which the light is blocked at the second and third sensors 66, 67, respectively, and the pivot speed of the hammer 63 is determined in accordance with the detected moving time.

In this conventional speed detecting apparatus 61, since the hammer 63 pivotally moves about the center pin 68, the shutter 64 integrated with the hammer 63 also moves along an arc centered at the center pin 68. On the other hand, the first to third sensors 65-67 are simply arranged in a straight line, so that if the shutter 64 is attached at a deviated position or angle due to errors in dimensions or assembly of parts, the shutter 64 will block the light from the first to third sensors 65-67 at actual points (hereinafter called the "light blocking points") which deviate from correct points, causing an associated change in stroke (hereinafter called the "light blocking stroke") of the hammer 63 actually required to block the light from the next sensor after it has blocked the light from a certain sensor. Since such a change in the light blocking stroke results in a change in the detected moving time of the shutter 64 between the sensors, the pivot speed of the hammer 63, determined on the basis of the moving time of the shutter 64, would be detected with a lower accuracy.

Such a disadvantage can be solved by correcting the position or angle at which the shutter 64 is attached. However, since the shutter 64 is generally driven into or adhered to the catch shank 63*a* for attachment thereto, great efforts will be exerted to modify the shutter 64 in position or angle of attachment, resulting in an increased manufacturing cost.

Laid-open Japanese Patent Application No. 09-068981, for example, also discloses a speed detecting apparatus for detecting a pivot speed of a key. As illustrated in FIG. 2, the disclosed speed detecting apparatus 71 comprises a pivotable key 72, a shutter 73 integrally arranged on the bottom surface of the key 72, two photo-couplers 74, 75 arranged below the shutter 73, and the like. The shutter 73 extends in the left-to-right and up-to-down directions, and is formed in a rectangular shape. The shutter 73 is formed with an optically transparent window 76. The optically transparent window 76 is formed in an inverted L-shape, made up of a left half 76*a* which extends over substantially the entirety of the shutter 73 in the vertical direction, and a right half 76*b* which extends to the right from the upper half of the left half 76*a*, where the lower end of the right half 76*b* is higher than the lower end of the left half 76*a*. The two photo-couplers 74, 75 are arranged side by side adjacent to each other, and comprise a pair of a light emitters 74*a* and a light receiver 74*b*, and a pair of a light emitter 75*a* and a light receiver 75*b*, respectively. These light emitters 74*a*, 75*a* and light receivers 74*b*, 75*b* are arranged on both sides of a path along which the shutter 73 moves.

In the structure as described above, as the key 72 is touched, the shutter 73 pivotally moves downward in association with a pivotal movement of the key 72, causing the lower end of the shutter 73 to reach the two photo-couplers 74, 75, thereby blocking light to the respective light receivers 74*b*, 75*b*. Next, as the lower end of the left half 76*a* of the optically transparent window 76 reaches the left-hand photo-coupler 74, light reaches the light receiver 74*b* of the photo-coupler 74. As the shutter 73 further pivotally moves, the lower end of the right half 76*b* of the optically transparent window 76 reaches the right-hand photo-coupler 75, permitting light to reach the light receiver 75*b* of the photo-coupler 75. Each of the photo-couplers 74, 75 generates a detection signal in response to the light reaching the light receiver 74*b*, 75*b* or blocked by the shutter 73. A pivot speed of the key 72 is detected in accordance with these detection signals.

Disadvantageously, in the conventional speed detecting apparatus 71 described above, the pivot speed of the key 72 is detected in accordance with the timings at which the single shutter 73 reaches the two photo-couplers 74, 75. As such, if the shutter 73 is obliquely attached as illustrated in FIG. 3, a shift will be brought in a light blocking stroke d between the left and right photo-couplers 74, 75, causing a consequent degradation in accuracy of detecting the pivot speed. While such a problem can be solved by modifying the angle at which the shutter 73 is attached, the modification will require great efforts, resulting in an increase in the manufacturing cost, from the same reason as the aforementioned Laid-open Japanese Patent Application No. 02-160292.

SUMMARY OF THE INVENTION

The present invention has been made to solve the problem as mentioned above, and it is an object of the invention to provide a speed detecting apparatus for a keyboard musical instrument, which is capable of accurately detecting a pivot speed of a hammer or a key, even if a shutter is attached with errors, without affected by such errors.

To achieve the above object, according to a first aspect of the present invention, there is provided a speed detecting apparatus for a keyboard musical instrument, which is characterized by comprising a pivotable key; a hammer pivotably supported by a fulcrum and configured to pivotally move in association with a pivotal movement of the key; a shutter integrally attached to the hammer; a plurality of detectors arranged along a pivotal movement path of the shutter, each having a light emitter and a light receiver for receiving light emitted from the light emitter, arranged on both sides of the pivotal movement path of the shutter, wherein the detectors have detection points on respective light paths of the light from the light emitters, and are arranged such that the detection points are positioned on an arc centered at the fulcrum of the hammer; and hammer speed detecting means for detecting a pivot speed of the hammer in accordance with timings at which the shutter opens and closes the light paths of the light from the light emitters of the plurality of detectors when the hammer pivotally moves.

According to this speed detecting apparatus for a keyboard musical instrument, the hammer pivotally moves about the fulcrum in association with a touch on the key. This pivotal movement of the hammer causes the shutter integrally attached to the hammer to sequentially open and close the light paths of the light from the light emitters of the plurality of detectors. The hammer speed detecting means detects the pivot speed of the hammer in accordance with the timings at which these light paths are opened and closed.

According to the first aspect of the present invention, the plurality of detectors are arranged such that their detection points are positioned on the arc centered at the fulcrum of the hammer, so that even if the shutter is attached at a shifted position or a shifted angle due to errors in dimensions or assembly of parts and therefore actually blocks the light paths at points deviated from correct points, the shutter can open and close the light paths at the same point of the shutter among the plurality of detectors. It is therefore possible to keep a correct stroke which is actually required by the hammer to open and close the light path of the next detector after it has opened and closed the light path of a certain detector. Consequently, the pivot speed of the hammer can be accurately detected without being influenced by errors, if any, in attaching the shutter.

Also, to achieve the above object, according to a second aspect of the present invention, there is provided a speed detecting apparatus for a keyboard musical instrument which is characterized by comprising a key pivotable about a fulcrum; a shutter integrally attached to the key; a plurality of detectors arranged along a pivotal movement path of the shutter, each having a light emitter and a light receiver for receiving light emitted from the light emitter, arranged on both sides of the pivotal movement path of the shutter, wherein the detectors have detection points on respective light paths of the light from the light emitters, and are arranged such that the detection points are positioned on an arc centered at the fulcrum of the key; and key speed detecting means for detecting a pivot speed of the key in accordance with timings at which the shutter opens and closes the light paths of the light from the light emitters of the plurality of detectors when the key pivotally moves.

According to this speed detecting apparatus for a keyboard musical instrument, as the key is touched, the key pivotally moves about the fulcrum, causing the shutter integrally attached to the key to sequentially open and close the light paths of the light from the light emitters of the plurality of detectors. The key speed detecting means detects the pivot speed of the key in accordance with the timings at which the light paths are opened and closed.

According to the second aspect of the present invention, the plurality of detectors are arranged such that their detection points are positioned on the arc centered at the fulcrum of the key, so that even if the shutter is attached at a shifted position or a shifted angle due to errors in dimensions or assembly of parts, it is possible to keep a correct stroke which is actually required by the key to open and close the light paths, as is the case with the aforementioned speed detecting apparatus of the first aspect. Consequently, the pivot speed of the key can be accurately detected without being influenced by errors, if any, in attaching the shutter.

Preferably, each of the speed detecting apparatuses of the first and second aspects further comprises adjusting means for adjusting the plurality of detectors such that the plurality of detection points are positioned on the arc.

According to this preferred embodiment of the speed detecting apparatuses, the adjusting means can facilitate the adjustment which is made such that the plurality of detection points are positioned on the arc centered at the fulcrum.

Preferably, in the speed detecting apparatuses of the first and second aspects, the detectors are mounted at predetermined mounting positions, and the adjusting means comprises a spacer interposed between each of the detectors and the predetermined mounting position.

According to this preferred embodiment of the speed detecting apparatuses, the adjusting means comprises a spacer, and by interposing the spacer between the detector and the predetermined mounting position, at which the detector is mounted, the detector can be finely adjusted in position and angle for mounting, thereby facilitating the positioning of the detection points on the arc.

Preferably, each of the speed detecting apparatuses of the first and second aspects further comprises a board on which the plurality of detectors are mounted, wherein the plurality of detectors are mounted on the board such that at least two of the plurality of detection points are spaced from the board by different distances from each other.

According to this preferred embodiment of the speed detecting apparatuses, the plurality of detectors are mounted on the board such that at least two of the plurality of detection points are spaced from the board by different distances from each other. Accordingly, even if three or more detectors are mounted, for example, on a single board, all the detection points can be positioned on the arc while using the single board.

Preferably, each of the speed detecting apparatuses of the first and second aspects further comprises a plurality of boards each having the plurality of detectors mounted thereon, wherein the plurality of boards are arranged at different angles from one another.

According to this preferred embodiment of the speed detecting apparatuses, since the plurality of boards, on which a plurality of detectors are mounted, are arranged at different angles from one another, the detection points can be readily positioned on the arc simply by setting these angles for the respective boards without using spacers. In addition, the position of the detection point can be finely adjusted for each board.

Preferably, in the speed detecting apparatuses of the first and second aspects, the plurality of boards are identical in configuration to one another.

According to this preferred embodiment of the speed detecting apparatuses, since a plurality of detectors are mounted on a plurality of boards which are identical in configuration to each other, it is possible to use in common the boards and detectors mounted thereon and correspondingly reduce the manufacturing cost.

DETAILED DESCRIPTION OF THE PREFERRED EMBODIMENTS

Figure 1:
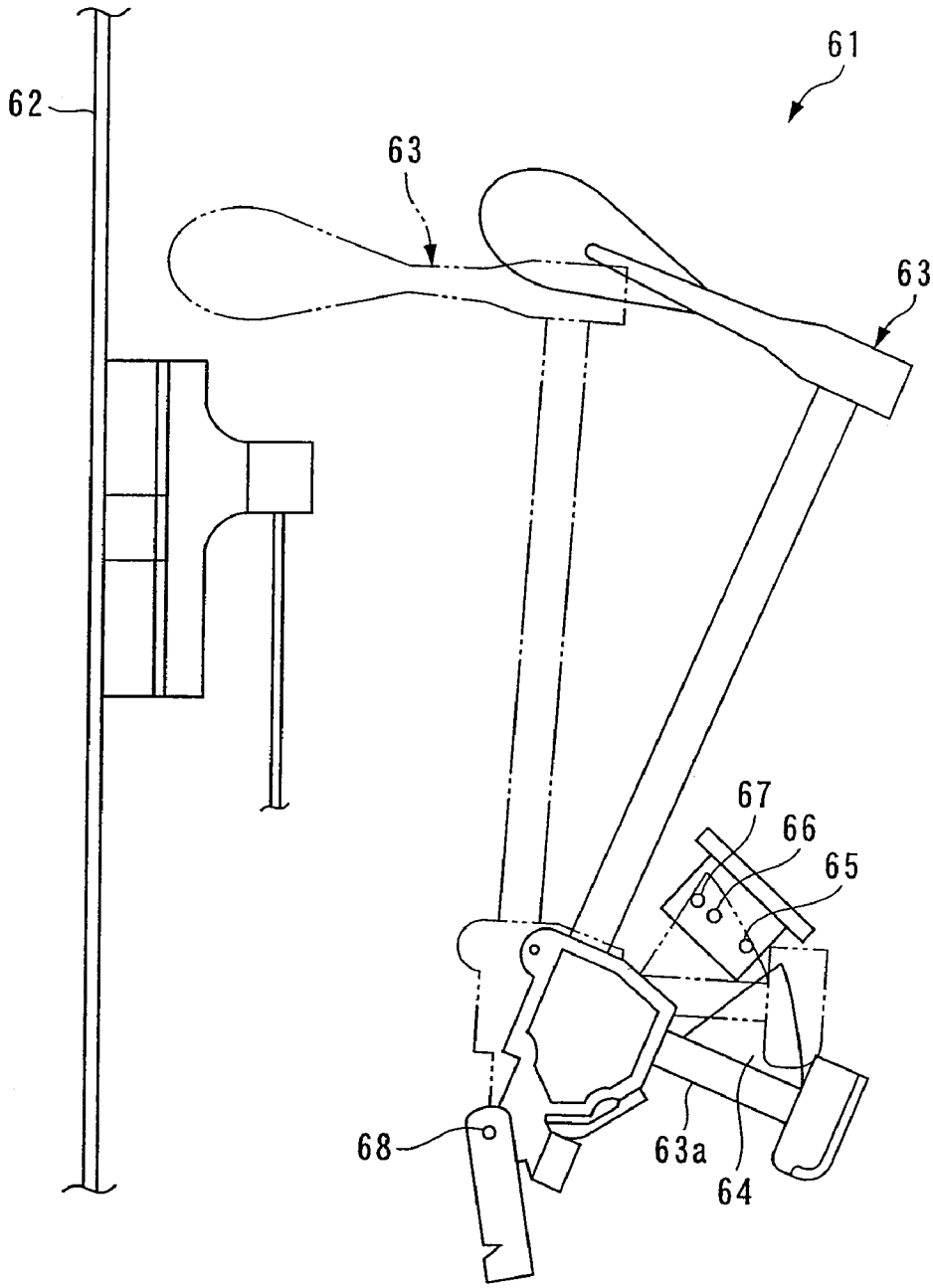
FIG. 1 is a side view of a conventional speed detecting apparatus for detecting a pivot speed of a hammer.
Figure 2:
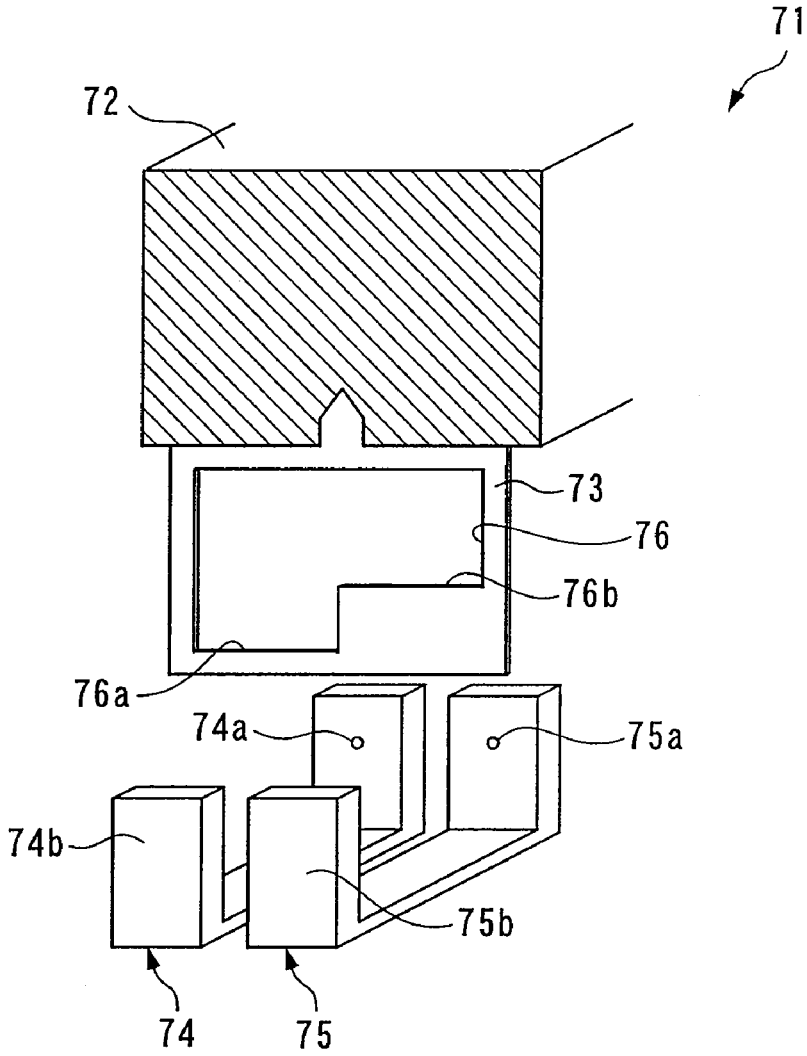
FIG. 2 is a partial perspective view of a conventional speed detecting apparatus for detecting a pivot speed of a key.
Figure 3:
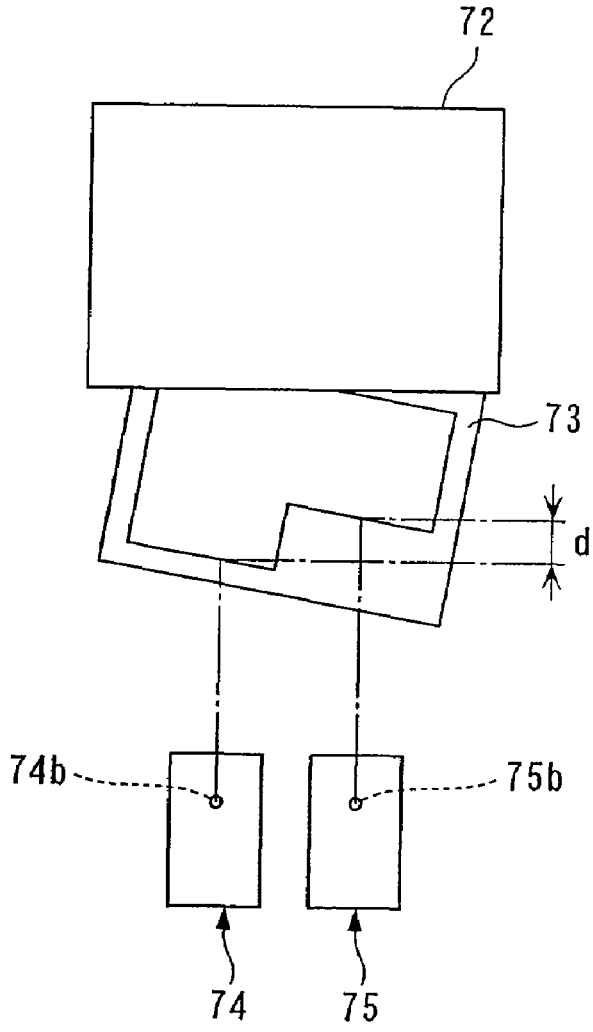
FIG. 3 is a front view of the shutter shown in FIG. 2, when it is obliquely attached.
Figure 4:
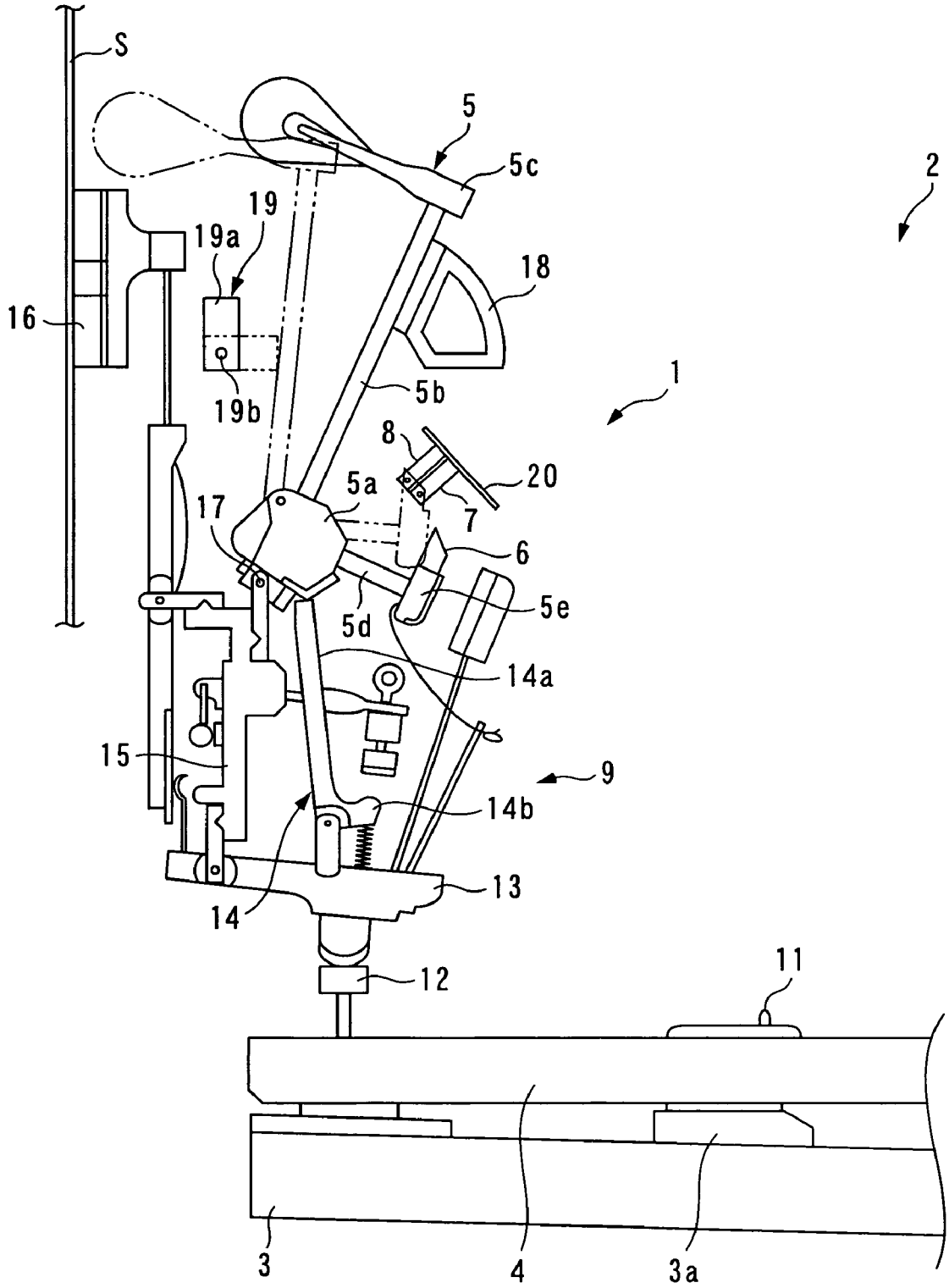
FIG. 4 is a side view generally illustrating the configuration of a speed detecting apparatus according to a first embodiment of the present invention, and a silent piano to which the speed detecting apparatus is applied.
Figure 5:
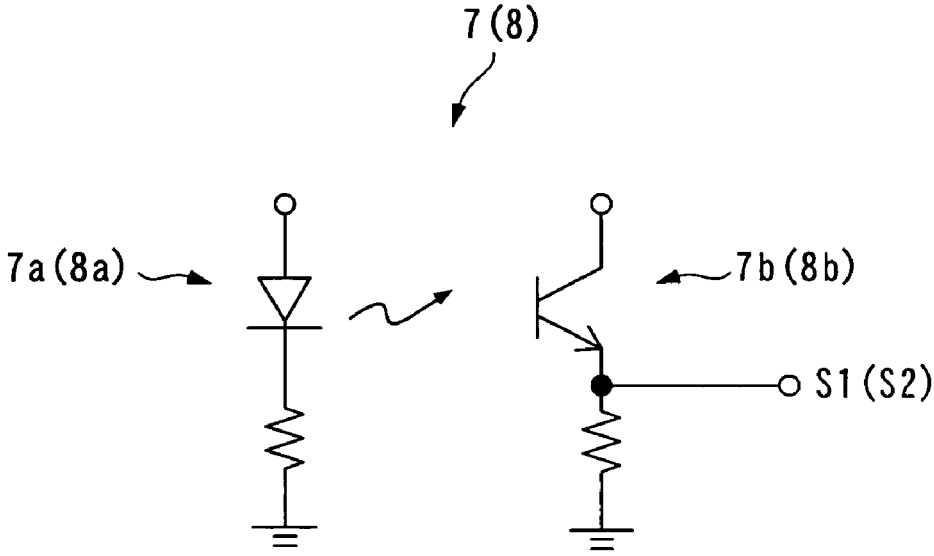
FIG. 5 is a circuit diagram of a first and a second photo-interrupter in FIG. 4.
Figure 6:
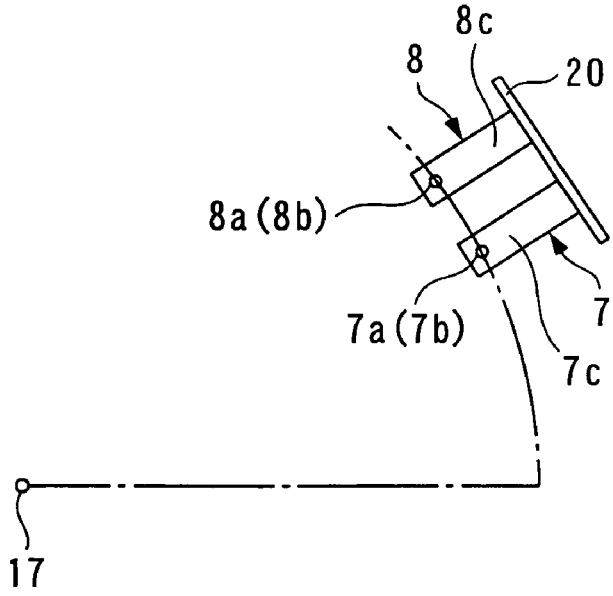
FIG. 6 is a partially enlarged view of FIG. 4.

In the following, a preferred embodiment of the present invention will be described in detail with reference to the accompanying drawings. FIGS. 4 to 6 illustrate an upright type silent piano 2 (keyboard musical instrument) to which a speed detecting apparatus 1 is applied according to a first embodiment of the present invention. In the following example, a front side, when the silent piano 2 is viewed from a player (right-hand side in FIG. 4) is defined to be the "front," a far side (left-hand side in FIG. 4) is defined to be the "rear," and the left and right sides are defined to be the "left" and "right," respectively.

Figure 8:
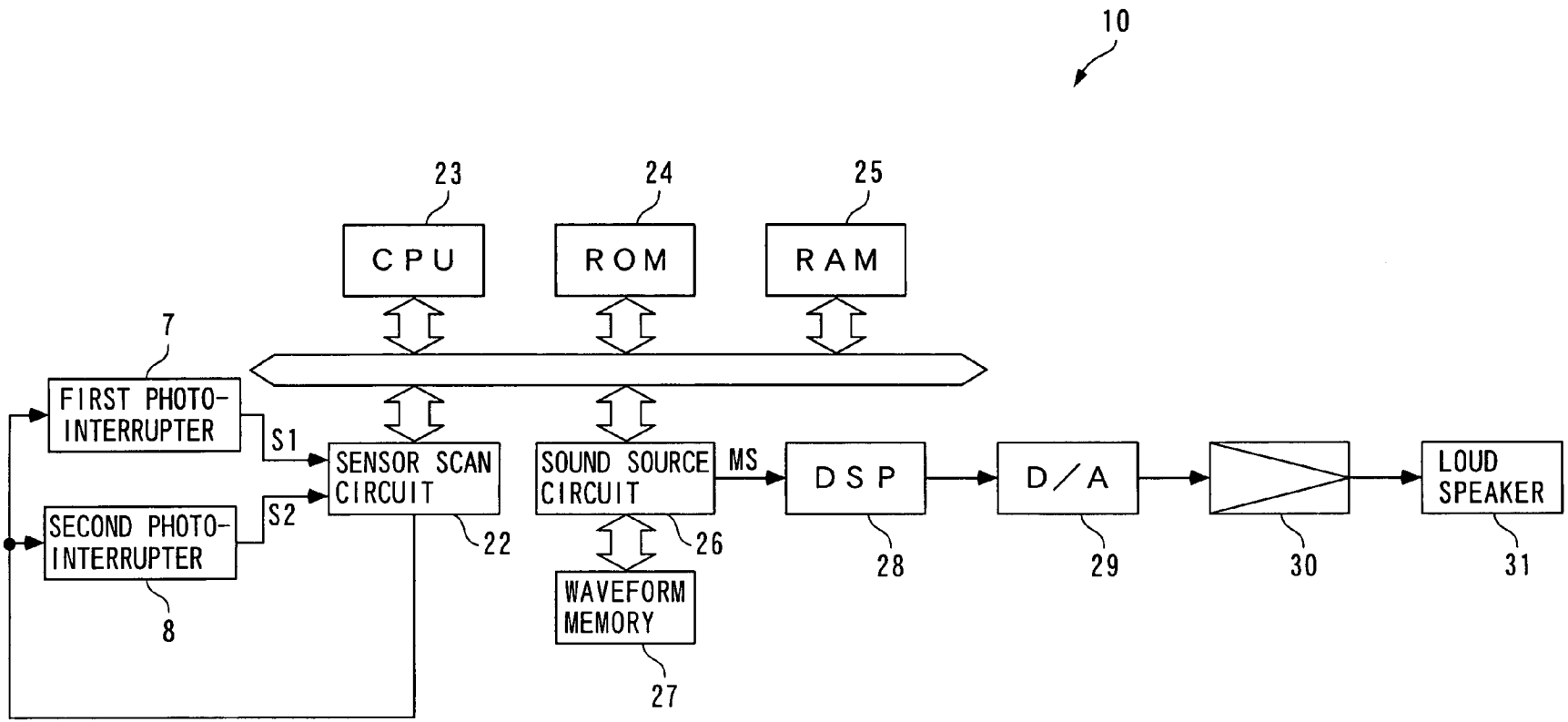
FIG. 8 is a diagram illustrating part of a sound generator in FIG. 4.

As illustrated in FIG. 4, the silent piano 2 comprises a plurality (for example, 88) of keys 4 (only one of which is shown) carried on a keybed 3, an action 9 disposed behind and above each key 4, and a hammer 5 provided for each key 4 for striking a string S. The silent piano 2 also comprises a shutter 6 associated with the hammer 5, a first and a second photo-interrupter 7, 8, a sound generator 10 (see FIG. 8) for electronically generating played sound, and the like. In this silent piano 2, a play mode is switched between a normal play mode in which acoustically played sound is generated by striking the string S by the hammer 5, and a silent play mode in which played sound is generated by the sound generator 10 while the hammer 5 is prevented from striking the string S.

The key 4 is pivotably supported by a balance pin 11 implanted on a balance rail 3*a* disposed on the keybed 3 through a balance pinhole (not shown) formed at the center of the key 4.

The action 9, which causes the hammer 5 to pivotally move in association with a touch on the key 4, comprises a wippen 13 extending in the front-to-rear direction and carried on a rear portion of each key 4 through a capstan screw 12, a jack 4 attached to the wippen 13, and the like. Each wippen 13 is pivotably supported by a center rail 15 at the rear end thereof. The jack 14 is formed in an L-shape, made up of an upthrust 14*a* extending in the vertical direction, and an engagement part 14*b* extending in front substantially at right angles from the lower end of the upthrust 14*a*, and is pivotably attached to the wippen 13 at the corner of the L-shape. A damper 16 is pivotably attached to the rear end of the center rail 15.

The hammer 5 in turn comprises a bat 5*a*, a hammer shank 5*b* extending upward from the bat 5*a*, a hammer head 5*c* attached to the upper end of the hammer shank 5*b*, a catch shank 5*d* extending in front from the bad 5*a*, a catch 5*e* attached to the front end of the catch shank 5*d*, and the like, and is pivotably supported by a center pin 17 (fulcrum) at the lower end of the bat 5*a*. In a key released state illustrated in FIG. 4, the leading end of the upthrust 14*a* of the jack 14 is engaged with the bat 5*a*, the hammer shank 5*b* is obliquely in contact with the hammer rail 18, and the hammer head 5*c* opposes the string S.

The shutter 6, which is made of an opaque material, is formed in the shape of a flat plate which extends in the front-to-rear and up-to-down directions. The shutter 6 is integrated with the upper end of the catch 5*e*, extends upward, and pivotally moves integrally with the hammer 5.

The first and second photo-interrupters 7, 8 are mounted on a board 20, and the former 7 is arranged on the lower side of a pivotal movement path of the shutter 6, while the latter 8 is arranged on the upper side of the same. The board 20, which extends in the left-to-right direction, and is attached to an attachment rail (not shown) at a predetermined position and at a predetermined angle such that the board 20 is oblique to the attachment rail. The attachment rail extends between brackets (not shown) arranged at the left and right ends of the keybed 3. The first and second photo-interrupters 7, 8 are arranged side by side on the board 20 for each key 4.

As illustrated in FIG. 5, the first and second photo-interrupters 7, 8 have the same configuration as each other, and comprise a pair of a light emitting diode 7*a* and a photo-transistor 7*b* or a pair of a light emitting diode 8*a* and a photo-transistor 8*b* placed in cases 7*c*, 8*c* formed in an inverted C-shape in a top plan view, such that the light emitting diodes 7*a*, 8*a* oppose the photo-transistors 7*b*, 8*b*, respectively. These components are electrically connected to the board 20. The light emitting diodes 7*a*, 8*a* and photo-transistors 7*b*, 8*b* are arranged on both sides of the pivotal movement path of the shutter 6 such that their light emitting surfaces (not shown) oppose the associated light receiving surfaces (not shown) at the same height. The light emitting diodes 7*a*, 8*a* emit light toward the photo-transistors 7*b*, 8*b*, respectively, from their light emitting surfaces. The photo-transistors 7*b*, 8*b* in turn receive the light on their light receiving surfaces, and transduce the received light into electric signals. The electric signals are outputted as a first and a second detection signal S1, S2 in accordance with the position of pivotally moving hammer 5.

Specifically, the light is detected at detection points on respective light paths which connect the light emitting surfaces of the light emitting diodes 7*a*, 8*a* to the light receiving surfaces of the photo-transistors 7*b*, 8*b*, respectively. As the light paths are blocked (closed) to prevent the light receiving surfaces from receiving light, the photo-transistors 7*b*, 8*b* are brought out of conduction between their collector and emitter, and accordingly output signals at L level from their emitters. On the other hand, as the light paths are opened to permit the light receiving surfaces to receive light, the photo-transistors 7*b*, 8*b* are brought into conduction between their collector and emitter, and accordingly output signals at H level from their emitters. As illustrated in FIG. 6, in this embodiment, the first and second photo-interrupters 7, 8 are arranged such that their light paths are positioned across an arc centered at the center pin 17.

Turning back to FIG. 4, a stopper 19 is disposed between the hammer 5 and the string S. This stopper 19 prevents the hammer 5 from striking the string S in the silent play mode, and comprises a body 19*a*, a cushion (not shown) attached to a leading end surface of the body 19*a*, and the like. The stopper 19 is pivotably supported by a fulcrum 19*b* at a proximal end of the body 19*a*, and is driven by a motor (not shown). The stopper 19 extends in the vertical direction in the normal play mode, and is driven to a retracted position (position indicated by solid lines in FIG. 4) at which the stopper 19 is retracted from a pivotable range of the hammer shank 5*b* of the hammer 5. On the other hand, the stopper 19 extends in the front-to-rear direction in the silent playmode, and is driven to an advance position (position indicated by two-dot chain lines in FIG. 4) at which the stopper 19 enters the pivotable range of the hammer shank 5*b*. The aforementioned motor is driven by a driving signal from the CPU 23.

With the foregoing configuration, as the key 4 is touched, the key 4 pivotally moves about the balance pin 11 in the clockwise direction in FIG. 4, causing the wippen 13 to pivotally move in the counter-clockwise direction in association with the pivotal movement of the key 4. The pivotal movement of the wippen 13 causes the jack 14 to move upward together with the wippen 13, so that the upthrust 14*a* of the jack 14 pushes up the bat 5*a*, causing the hammer 5 to pivotally move in the counter-clockwise direction. In the normal play mode, the stopper 19 is driven to the retracted position, thereby permitting the hammer head 5*c* to strike the string S. In the silent play mode, on the other hand, the stopper 19 is driven to the advanced position, causing the hammer shank 5*b* to abut to the stopper 19 immediately before the hammer head 5*c* strikes the string S, thus preventing the hammer head 5*c* from striking the string S. Also, during the pivotal movement of the hammer 5, the shutter 6 sequentially blocks the light paths of the first and second photo-interrupters 7, 8, causing them to output the first and second detection signals S1, S2.

Figure 7:
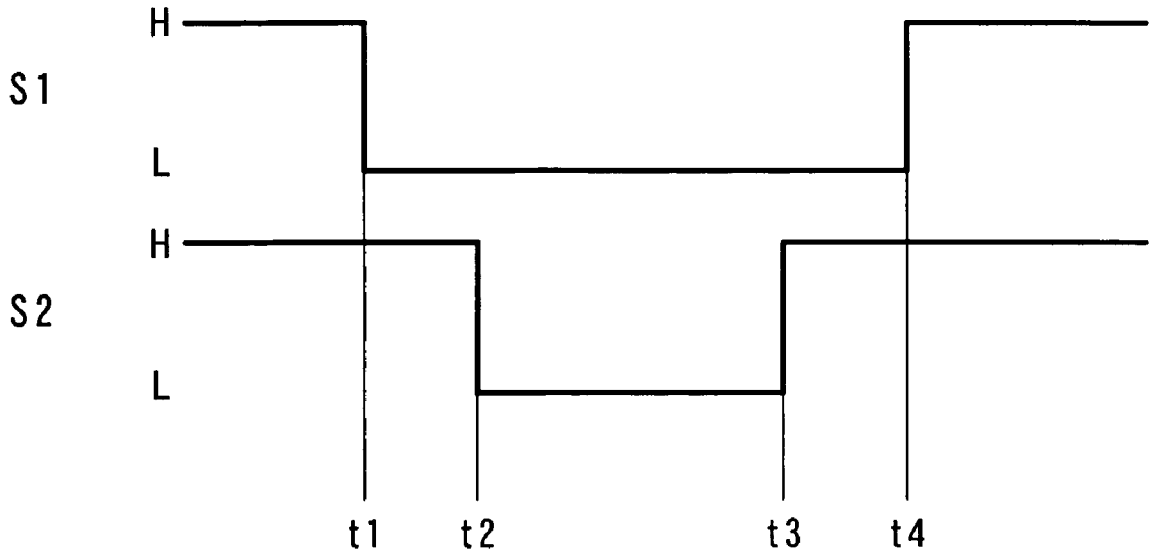
FIG. 7 illustrates a timing chart of a first and a second detection signal when a key is touched and when the key is released.

FIG. 7 illustrates a timing chart of the first and second detection signals S1, S2 associated with the pivotal movement of the hammer 5. First, in the key released state illustrated in FIG. 4, the shutter 6 opens the light paths of the first and second photo-interrupters 7, 8, permitting them to generate the first and second detection signals S1, S2 both at H level. When the key 4 is touched in the key released state, causing the hammer 5 to pivotally move, the light path of the first photo-interrupter 7 is blocked in the midway of the pivotal movement at the time the leading end of the shutter 6 reaches the light path of the first photo-interrupter 7, thereby forcing the first detection signal S1 to go down from H level to L level (at timing t1). As the hammer 5 further pivotally moves, the light path of the second photo-interrupter 8 is blocked at the time the leading end of the shutter 6 reaches the light path of the second photo-interrupter 8 near a location at which the hammer shank 5*b* abuts to the stopper 19, forcing the second detection signal S2 to go down from H level to L level (at timing t2). Subsequently, as the key 4 is released, the hammer 5 pivotally moves in the opposite direction to that when the key 4 is touched, for returning to the original position. The light path of the second photo-interrupter 8 is opened in the midway of the pivotal movement of the hammer 5, forcing the second detection signal S2 to go from L level to H level (at timing t3). As the shutter 6 further pivotally moves closer to the original position, the light path of the photo-interrupter 7 is also opened, forcing the first detection signal S to go from L level to H level (at timing t4).

The sound generator 10 generates sound in the silent play mode, and comprises a sensor scan circuit 22, a CPU 23, a ROM 24, a RAM 25, a sound source circuit 26, a waveform memory 27, a DSP 28, a D/A converter 29, a power amplifier 30, a loud speaker 31, and the like. The sensor scan circuit 22 detects ON/OFF information on the key 4, and key number information which identifies the touched or released key 4 based on the first and second detection signals S1, S2 outputted from the first and second photo-interrupters 7, 8, and outputs the ON/OFF information and key number information to the CPU 23 together with the first and second detection signals S1, S2 as key touch information data on the key 4. Also, the sensor scan circuit 22 comprises a down-counting type counter (not shown) for measuring the time until the second detection signal S2 is pulled down from H level to L level after the first detection signal S has been pulled down from H level to L level, and outputs a count value cnt to the CPU 23.

The ROM 24 stores a control program executed by the CPU 23, and fixed data for controlling the volume and the like. The RAM 25 in turn temporarily stores status information indicative of an operating condition in the silent play mode, and the like, and is also used as a work area for the CPU 23.

The sound source circuit 26 retrieves sound source waveform data and envelope data from the waveform memory 27 in accordance with a control signal from the CPU 23, and adds the envelope data to the retrieved sound source waveform data to generate a sound signal MS which is source sound. The DSP 28 adds a predetermined acoustic effect to the sound signal MS generated by the sound source circuit 26. The D/A converter 29 converts the sound signal MS, to which an acoustic effect has been added by the DSP 28, from a digital signal to an analog signal. The power amplifier 30 amplifies the converted analog signal at a predetermined gain, and the loudspeaker 31 reproduces the amplified analog signal for radiating the sound.

The CPU 23 controls the operation of the sound generator 10 in the silent play mode. The CPU 23 determines sound generation start and stop timings in accordance with the first and second detection signals S1, S2 from the first and second photo-interrupters 7, 8, and determines a velocity for controlling the volume in accordance with the pivot speed V of the hammer 5.

Figure 9:
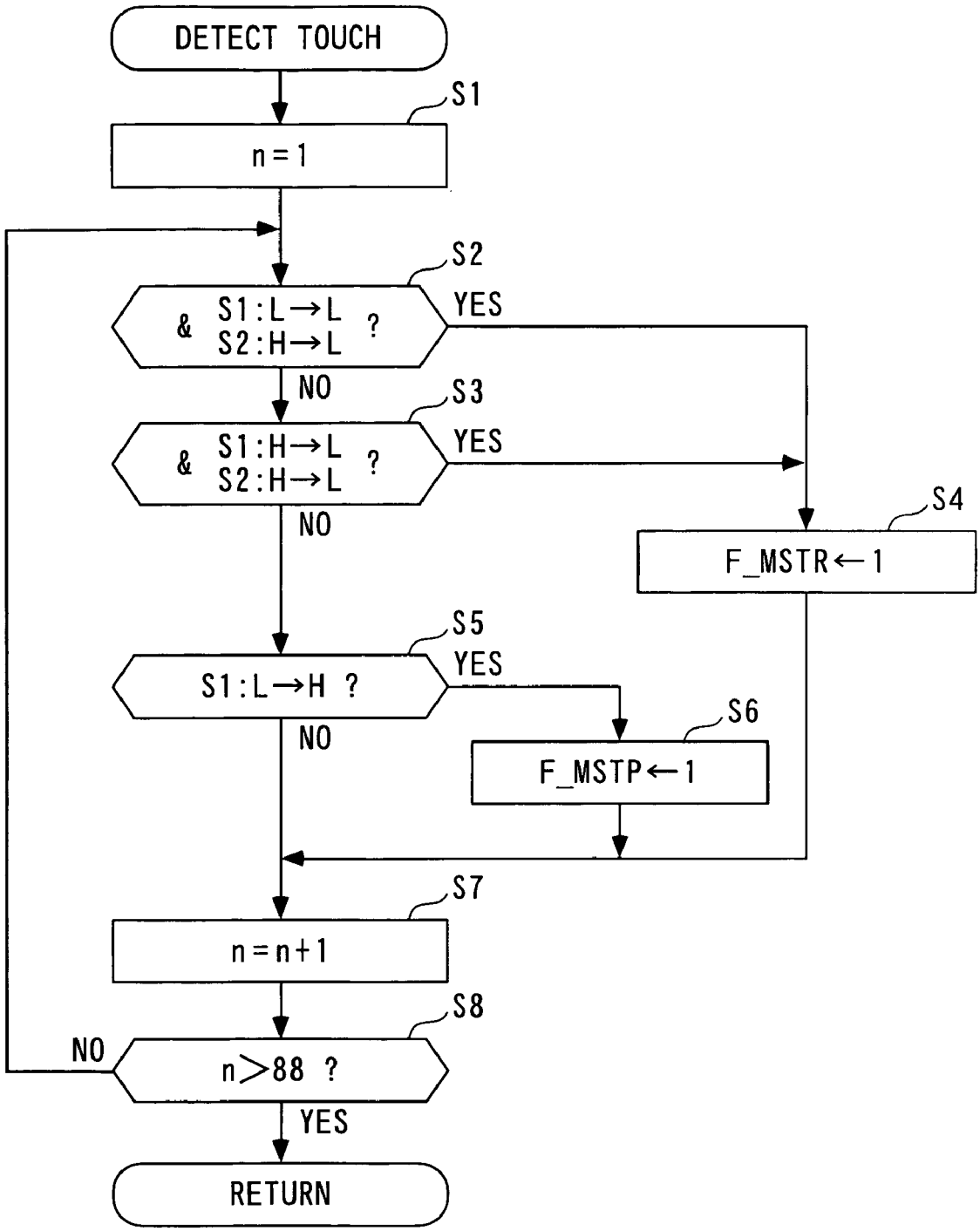
FIG. 9 is a flow chart illustrating a routine executed by a CPU in FIG. 8 for determining timings at which sound is generated and the sound is stopped.

FIG. 9 is a flow chart illustrating a routine executed by the CPU 23 for determining the aforementioned sound generation start and stop timings. This routine is executed sequentially for all of the 88 keys 4. In this routine, a key number n (n=1–88) for the key 4 is first initialized to one at step 1 (labeled "S1" in the figure. The same applies to the following figures).

Next, the CPU 23 determines whether or not the first detection signal S1 from the first photo-interrupter 7 remains at L level and whether or not the second detection signal S2 from the second photo-interrupter 8 has changed from H level to L level between the previous time and the current time (step 2). If the result of the determination is YES, i.e., if the timing is immediately after the light path of the second photo-interrupter 8 is blocked by the shutter 6 while the light path of the first photo-interrupter 7 had been blocked by the shutter 6, the CPU 23 sets a sound generation start flag F_MSTR to "1" (step 4) in order to start the generation of sound on the assumption that the key 4 is touched.

If the result of the determination at step 2 is NO, the CPU 23 determines whether or not both the first and second detection signals S1, S2 have changed from H level to L level between the previous time and the current time (step 3). If the result of the determination is YES, indicating that the light paths of the first and second photo-interrupters 7, 8 have been simultaneously blocked by the shutter 6, the routine proceeds to step 4, where the CPU 23 sets the sound generation start flag F_MSTR to "1."

The sound generation start timing is determined in consideration of the first detection signal S1 as well as the second detection signal S2 for the reason set forth below. Assuming that the key 4 is being normally touched, when the second detection signal S2 changes from H level to L level, the first detection signal S1 remains at L level or must change from the H level to L level if the key touch speed is very high. Therefore, if the first detection signal S1 indicates a value other than the aforementioned one at the time the second detection signal S2 changes to L level, the result of the detection at that time is excluded on the assumption that the key 4 is not normally touched, thereby making it possible to prevent an erroneous detection. Also, when the sound generation start flag F_MSTR is set to "1," a control signal for starting the sound generation is outputted to the sound source circuit 26 to start a sound generation starting operation.

On the other hand, if the result of the determination at step 3 is NO, the CPU 23 determines whether or not the first detection signal S1 has changed from L level to H level (step 5). If the result of the determination is YES, indicating a timing immediately after the optical path of the first photo-interrupter 7 is opened, the CPU 23 sets a sound generation stop flag F_MSTP to "1" in order to stop the generation of sound, on the assumption that the key 4 has been released (step 6). When the sound generation stop flag F_MSTP is set to "1" in this way, a control signal for stopping the generation of sound is outputted to the sound source circuit 26 to start a sound generation stopping operation.

On the other hand, if the result of the determination at step 5 is NO, or after the CPU 23 executes the aforementioned step 4 or step 6, the CPU 23 increments the key number n and sets the resultant key number n for use at the next time (step 7). Then, the CPU 23 determines whether or not the set key number n is larger than 88 (step 8). If the result of the determination is NO, indicating n≦88, the routine returns to step 2, from which the CPU 23 again executes the routine described above. On the other hand, if the result of the determination at step 8 is YES, indicating n>88, i.e., when the sound generation start and stop timings have been determined for all the 88 keys, the CPU 23 terminates this routine.

Figure 10:
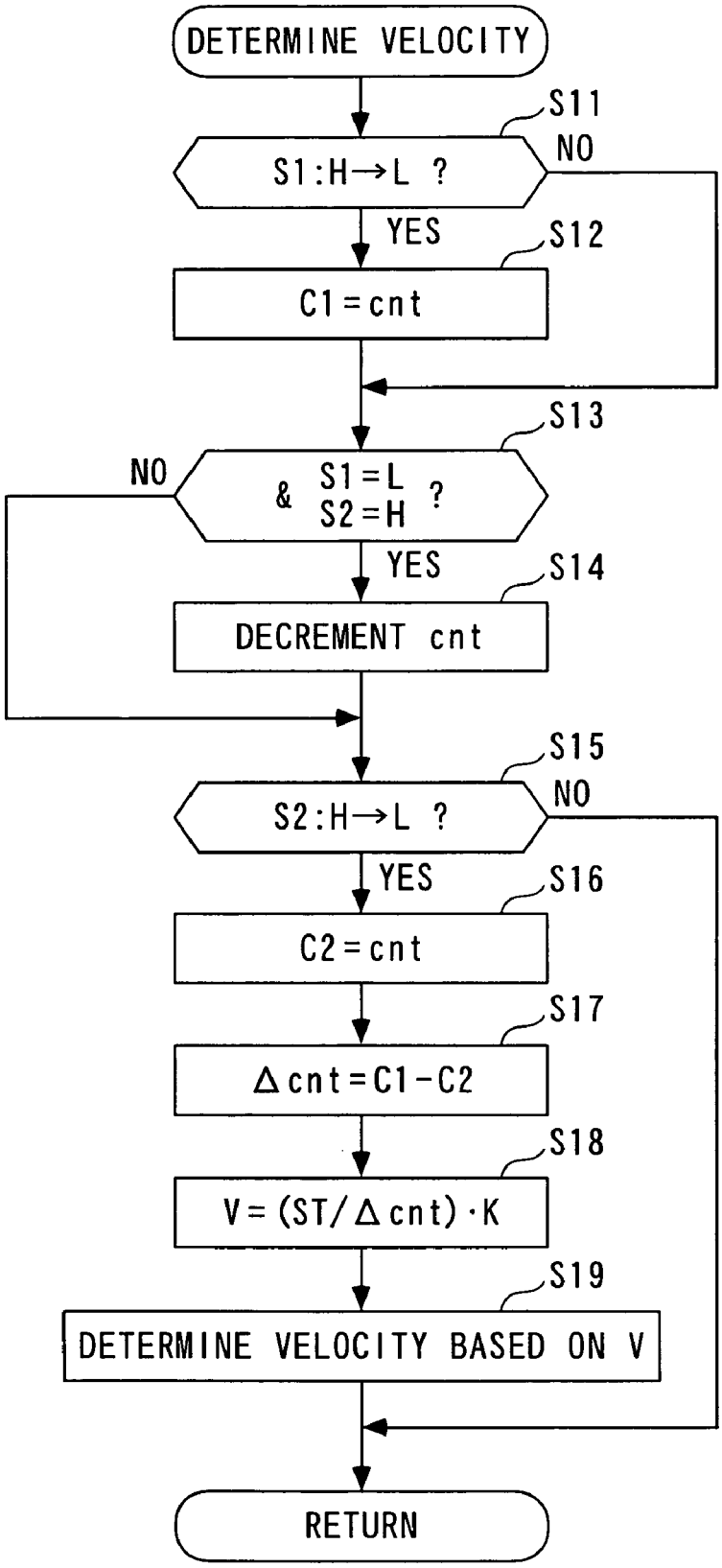
FIG. 10 is a flow chart illustrating a routine executed by the CPU in FIG. 8 for determining a velocity.

FIG. 10 is a flow chart illustrating a routine for determining the aforementioned velocity. In this routine, the CPU 23 first determines whether or not the first detection signal S1 has changed from H level to L level (step 11). If the result of the determination is YES, indicating a timing immediately after the light path of the first photo-interrupter 7 is blocked by the shatter 6, the CPU 23 sets the counter value cnt at that time as a first counter value C1 (step 12), followed by a transition to step 13.

On the other hand, if the result of the determination at step 11 is NO, indicating that the first detection signal S1 has not changed from H level to L level, the CPU 23 skips step 12, and proceeds to step 13. At step 13, the CPU 23 determines whether or not the first detection signal S1 is at L level and the second detection signal is at H level. If the result of the determination is YES, indicating that the light path of the second photo-interrupter 8 is been blocked by the shutter 6 after the shutter 6 has blocked the light path of the first photo-interrupter 7, the CPU 23 decrements the counter value cnt (step 14), and proceeds to step 15.

On the other hand, if the result of the determination at step 13 is NO, the CPU 23 skips step 14, and proceeds to step 15 without decrementing the counter value cnt. At step 15, the CPU 23 determines whether or not the second detection signal S2 has changed from H level to L level. If the result of the determination is NO, the CPU 23 terminates this routine.

On the other hand, if the result of the determination at step 15 is YES, indicating a timing immediately after the light path of the second photo-interrupter 8 is blocked by the shutter 6, the CPU 23 sets the counter value cnt at this time as a second counter value C2 (step 16).

Next, the CPU 23 calculates the difference Δcnt (C1-C2) between the first counter value C1 and the second counter value C2 (step 17). As will be apparent from the calculation method so far described, the difference Δcnt corresponds to a time required by the shutter 6 to block the light path of the second photo-interrupter 8 after it has blocked the light path of the first photo-interrupter 7, and is proportional to the pivot speed V of the hammer 5. Next, the CPU 23 divides a light blocking stroke (the length between the detection points) between the first and second photo-interrupters 7, 8 by the difference Δcnt, and multiplies the resultant quotient by a coefficient K to calculate the pivot speed V of the hammer 5 (step 18). The coefficient K converts the difference Δcnt to a time, and is set to a predetermined value. Then, the CPU 23 determines the velocity based on the pivot speed V calculated at step 18 (step 19), followed by termination of the routine.

While in the foregoing example, the CPU 23 determines the velocity based on key touch information data from the sensor scan circuit 22, the sensor scan circuit 22 and CPU 23 may be replaced by a dedicated detecting means for detecting the key touch information data and determining the velocity based on the detected key touch information data, for example, a large-scaled integrated circuit (LSI) or the like. With such a dedicated detecting means, the CPU 23 can be less loaded.

As described above, according to this embodiment, the first and second photo-interrupters 7, 8 are arranged such that their detection points are positioned on the arc centered at the center pin 17. Thus, even if the shutter 6 is attached at a shifted position or a shifted angle due to errors in dimensions or assembly of parts and therefore actually blocks the light paths at points deviated from correct points, the shutter 6 can block the light paths of the first and second photo-interrupters 7, 8 at points which are located on the same arc. It is therefore possible to keep a correct light blocking stroke ST which is actually required by the hammer 5 to block the light path of the second photo-interrupter 8 after it has blocked the light path of the first photo-interrupter 7. Consequently, the pivot speed V of the hammer 5 can be accurately detected without being influenced by errors, if any, in attaching the shutter 6.

Figure 11:
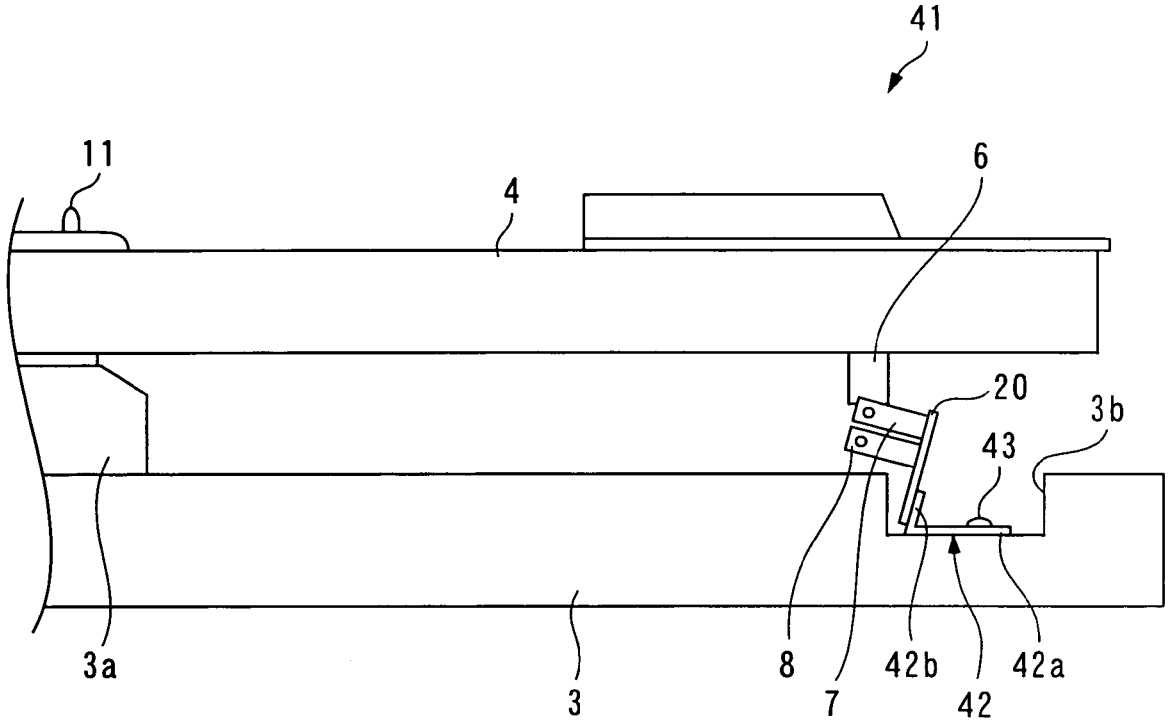
FIG. 11 is a partially enlarged view of a speed detecting apparatus according to a second embodiment of the present invention.

FIG. 11 illustrates a speed detecting apparatus 41 according to a second embodiment of the present invention. The speed detecting apparatus 41 of the second embodiment differs from the speed detecting apparatus of the first embodiment in that the former has the shutter 6 associated with the hammer 5 to detect the pivot speed V of the hammer 5, whereas the latter has the shutter 6 associated with the key 4 to detect a pivot speed V of the key 4. In the following description, the same components as those in the first embodiment are designated the same reference numerals, and detailed description thereon is omitted.

In the speed detecting apparatus 41, the shutter 6 is made of an opaque material, and is formed in the shape of a flat plate which extends in the front-to-rear and up-to-down directions, as is the case with the first embodiment. The shutter 6 is integrally attached to the bottom surface of the key 4 in a front portion, and extends downward. A first and a second photo-interrupter 7, 8 are mounted on a board 20, where the former 7 is arranged on the upper side of a pivotal movement path of the key 4 below the shutter 6, while the latter 8 is arranged on the lower side of the same. The board 20 is obliquely mounted to a fixture 42 attached to a keybed 3 at a predetermined angle. The fixture 42 comprises a body 42*a* extending in the front-to-rear direction, and a bracket 42*b* which is bent obliquely upward from the rear end of the body 42*a*, and the board 20 is mounted to the bracket 42*b*. The fixture 42 is fitted in a recess 3*b* formed in the top surface of the keybed 3 in a front portion, and is fixed to the keybed 3 by screwing a screw 43 into the keybed 3 through a hole (not shown) formed through the body 42*a*.

Like the first embodiment, the first and second photo-interrupters 7, 8 comprise light emitting diodes 7*a*, 8*a* and photo-transistors 7*b*, 8*b*, respectively, which are electrically connected to the board 20. In this embodiment, the first and second photo-interrupters 7, 8 are arranged such that their light paths are positioned across an arc centered at a balance pin 11 (fulcrum).

In the foregoing configuration, as the key 4 pivotally moves, the shutter 6 sequentially blocks the light paths of the first and second photo-interrupters 7, 8 in a manner similar to the first embodiment. Then, sound generation start and stop timings are determined for the key 4, and the pivot speed V is detected in accordance with output timings of a first and a second detection signal S1, S2 which are outputted in response to the blockage of the light paths.

As described above, according to the second embodiment, since the first and second photo-interrupters 7, 8 are arranged such that their detection points are positioned on the arc centered at the balance pin 11, it is possible to keep a correct light blocking stroke ST of the key 4 which is actually required to block the light paths even if the shutter 6 is attached at a shifted position or angle, in a manner similar to the first embodiment. Consequently, the pivot speed V of the key 4 can be accurately detected without being influenced by errors, if any, in attaching the shutter 6.

Figure 12A:
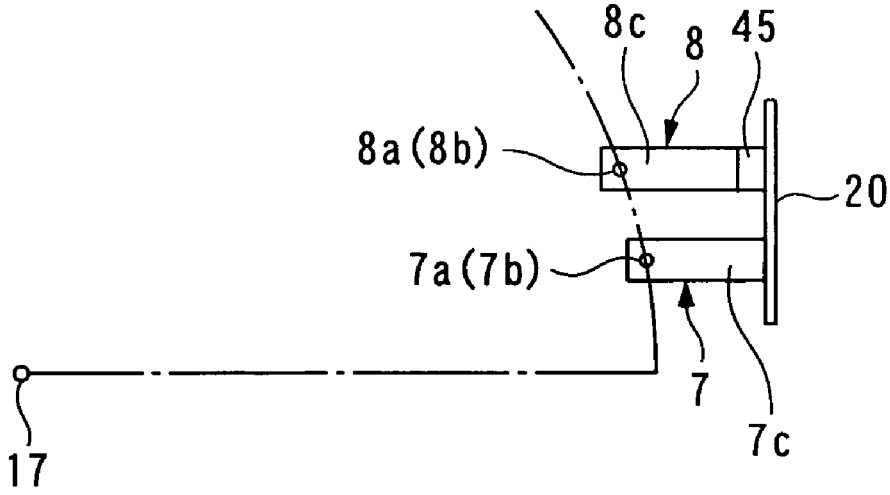
FIGS. 12A and 12B are side views illustrating speed detecting apparatuses for a hammer (FIG. 12A) and for a key (FIG. 12B), respectively, in a first exemplary modification of the present invention.

FIG. 12A illustrates a first exemplary modification to the first embodiment. This exemplary modification differs from the first embodiment in the angle at which the board 20 is attached. Specifically, in the first embodiment, the board 20 is obliquely attached at a predetermined angle, whereas in the illustrated exemplary modification, the board 20 is attached at right angles. Also, a spacer 45 is interposed between the case 8*c* of the second photo-interrupter 8 and the board 20. The spacer 45 is provided to adjust the second photo-interrupter 8 such that its detection point is positioned on an arc centered at a center pin 17, and has a predetermined thickness. Also, the spacer 45 may be a single piece extending from left to right and shared by the second photo-interrupters 8, or may be provided for each second photo-interrupter 8.

According to the foregoing configuration, the second photo-interrupter 8 can be finely adjusted in position and angle for mounting by the spacer 45 interposed between the second photo-interrupter 8 and the board 20, so that the detection point can be readily positioned on the arc.

Figure 12B:
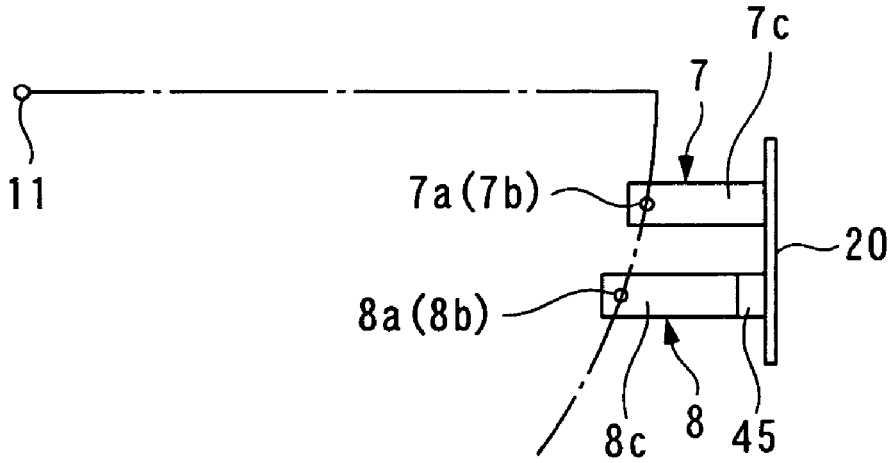

FIG. 12B illustrates the first exemplary modification when it is applied to the second embodiment, in which case the spacer 45 is interposed between the second photo-interrupter 8, positioned on the lower side, and the board 20 to position the detection point of the second photo-interrupter 8 on the arc centered at the balance pin 11, thereby making it possible to provide the aforementioned advantages of the first exemplary modification in a similar manner.

Figure 13A:
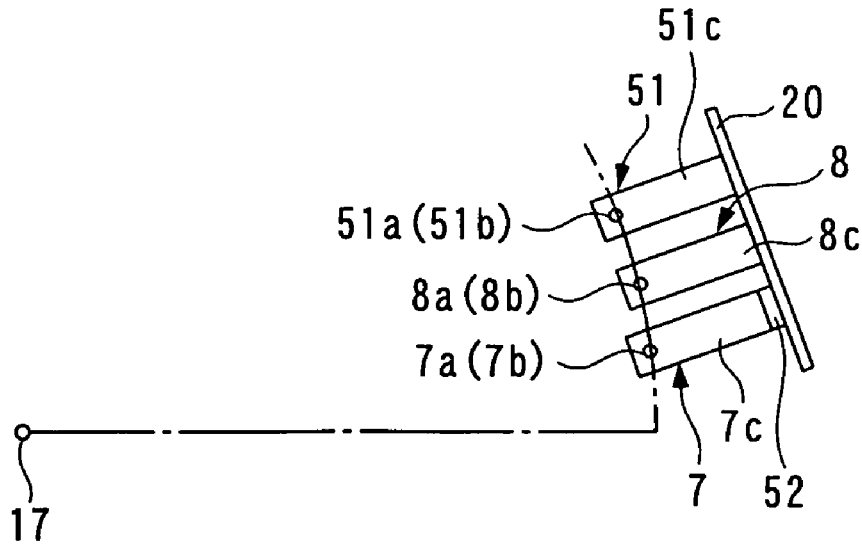
FIGS. 13A and 13B are side views illustrating speed detecting apparatuses for a hammer (FIG. 13A) and for a key (FIG. 13B), respectively, in a second exemplary modification of the present invention.

FIG. 13A illustrates a second exemplary modification to the first embodiment. Unlike the first embodiment, this exemplary modification comprises a third photo-interrupter 51 above the second photo-interrupter 8 in addition to the first and second photo-interrupters 7, 8. These first to third photo-interrupters 7, 8, 51 are mounted on the board 20. Also, a spacer 52 having a predetermined thickness, similar to that of the first exemplary modification, is interposed between the case 7*c* of the first photo-interrupter 7 and the board 20. The first photo-interrupter 7 is adjusted by the spacer 52 such that its detection point is positioned on an arc centered at a center pin 17, and any of the detection points of the first to third photo-interrupters 7, 8, 51 are positioned on the arc centered at the center pin 17. In this second exemplary modification, the sound generation start and stop timings are determined, for example, in accordance with the first and second detection signals S1, S2 of the first and second photo-interrupters 7, 8, and the pivot speed V of the hammer 5 is detected based on a time required until the light path of the third photo-interrupter 51 is blocked after the light path of the second photo-interrupter 8 has been blocked.

According to the foregoing configuration, since the detection points of the first to third photo-interrupters 7, 8, 51 are all positioned on the arc centered at the center pin 17, it is possible to keep a correct light blocking stroke ST of the hammer 5 which is actually required to block the light paths even if the shutter 6 is attached at a shifted position or angle, as is the case with the first embodiment. Consequently, the pivot speed V of the hammer 4 can be accurately detected without being influenced by errors in attaching the shutter 6. Also, like the first exemplary modification, the first photo-interrupter 7 can be finely adjusted in position and angle for mounting by the spacer 52 interposed between the first photo-interrupter 7 and the board 20, and all the detection points can be positioned on the same arc even though the single board 20 is used.

Figure 13B:
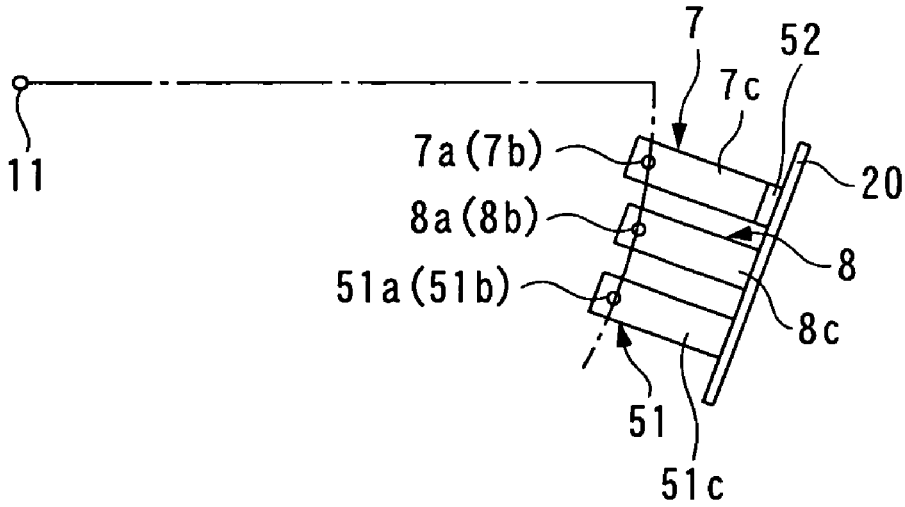

FIG. 13B illustrates the second exemplary modification when it is applied to the second embodiment, in which case, a third photo-interrupter 51 is added below the second photo-interrupter 8, and a spacer 52 is interposed between the first photo-interrupter 7 and the board 20, so that detection points of the first to third photo-interrupters 7, 8, 51 are all positioned on the arc centered at the balance pin 11. Accordingly, the aforementioned advantages of the second exemplary modification can be provided in a similar manner.

Figure 14A:
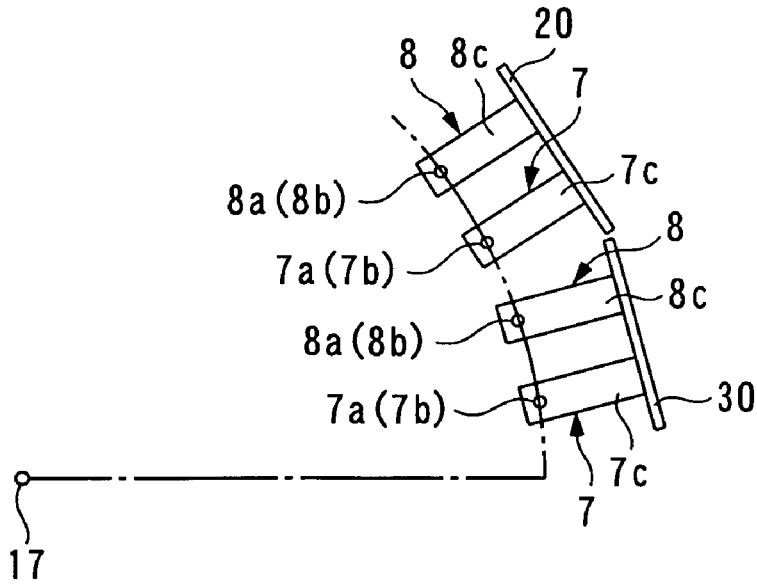
FIGS. 14A and 14B are side views illustrating speed detecting apparatuses for a hammer (FIG. 14A) and for a key (FIG. 14B), respectively, in a third exemplary modification of the present invention.

FIG. 14A illustrates a third exemplary modification to the first embodiment. This exemplary modification differs from the first embodiment in that two boards 20, 30 are used. A first photo-interrupter 7 and a second photo-interrupter 8, similar to those in the first embodiment, are mounted on each of the boards 20, 30. These boards 20, 30 are attached to an attachment rail (not shown) at predetermined angles different from each other, such that the first and second photo-interrupters 7, 8 mounted on the two boards 20, 30 are arranged in such a manner that a total of four detection points are positioned on an arc centered at a center pin 17. In the third exemplary modification, sound generation start and stop timings are determined, for example, in accordance with detection signals S1, S2 of the first and second photo-interrupters 7, 8 on the board 20. A pivot speed V of the hammer 5 is detected based on a maximum value or an average value of times required to sequentially block the two photo-interrupters 7, 8 on the board 20 and between the two photo-interrupters 7, 8 on the board 30. In this way, the pivot speed V of the hammer 5 can be more accurately detected while reflecting the actual pivot speed V of the hammer 5. In addition, the four detection points positioned on the same arc can ensure a certain accuracy of detection even when the shutter 6 is shifted in position or angle in its attachment.

According to the foregoing configuration, since the two boards 20, 30, each of which has the first and second photo-interrupters 7, 8 mounted thereon, are arranged at different angles from each other, the detection points can be readily positioned on the arc simply by setting the angle for each of the boards 20, 30, unlike the first and second exemplary modifications. Also, the positions of the detection points can be finely adjusted for each of the boards 20, 30. Further, since these boards 20, 30 are identical in configuration to each other, the boards 20, 30 and the first and second photo-interrupters 7, 8 mounted thereon can be used in common, resulting in a corresponding reduction in the manufacturing cost.

Figure 14B:
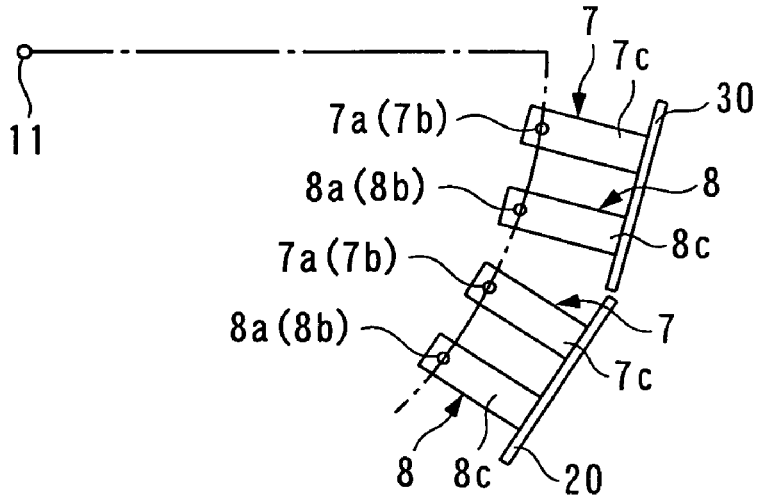

FIG. 14B illustrates the third exemplary modification when it is applied to the second embodiment, in which case, a board 30 is added on the upper side, and these boards 20, 30 are attached at different angles from each other, such that all detection points of the first and second photo-interrupters 7, 8 are positioned on the arc centered at the balance pin 11. Accordingly, the aforementioned advantages of the third exemplary modification can be provided in a similar manner.

It should be understood that the present invention is not limited to the embodiments described above, but can be practiced in a variety of implementations. For example, while a photo-diode and a photo-transistor are used for the light emitter and light receiver, respectively, a light emitting element such as a laser diode, and a light receiving element such as a photo-diode may be used instead. Also, in the foregoing embodiments, the light emitting diode and photo-transistor are directly placed in the case, but optical fibers may be arranged in the case on the light emitting side and light receiving side, respectively, such that they oppose each other, and a light emitting element and a light receiving element may be arranged at distal ends of the associated optical fibers. In this alternative, since the light emitting element and light receiving element can be arranged at positions far away from the pivotal movement path of the shutter, the degree of freedom can be increased for their arrangement.

Further, while in the foregoing embodiments, the pivot speed of the key 4 or hammer 5 is detected in accordance with the timings at which the shutter 6 blocks the light paths of the first and second photo-interrupters 7, 8, the present invention is not limited to this way of detection. Alternatively, the shutter 6 may be formed, for example, with a slit or a window, such that the pivot speed is detected in accordance with timings at which the light paths are opened by the slit or window. Also, while the foregoing embodiments and exemplary modifications employ two to four photo-interrupters per key 4 or hammer 5, the number of photo-interrupters may be increased per key 4 or hammer 5. Further, while the shutter 6 is attached to the catcher 5*e* of the hammer 5 in the first embodiment, the present invention is not so limited, but the shutter 6 maybe attached, for example, to the catch shank 5*d*, hammer shank 5*b* or the like.

Further, while the foregoing embodiments have shown the upright type silent piano 2 to which the present invention is applied, the present invention is not limited to this particular type of piano, but can also be applied to a grand type silent piano and further to other types of keyboard musical instruments such as an automatically playing piano, an electronic piano and the like. The speed detecting apparatus 41 according to the second embodiment can be applied as well to other types of keyboard musical instruments such as an electronic piano which does not have hammers, not to mention the automatically playing piano and electronic piano which have hammers. Otherwise , details can be modified as appropriate within the scope of the present invention.

What is claimed is:

1. A speed detecting apparatus for a keyboard musical instrument comprising:

a pivotable key;

a hammer pivotably supported by a fulcrum and configured to pivotally move in association with a pivotal movement of said key;

a shutter integrally attached to said hammer;

a plurality of detectors arranged along a pivotal movement path of said shutter, each having a light emitter and a light receiver for receiving light emitted from said light emitter, arranged on one and the other sides of the pivotal movement path of said shutter, said detectors having detection points on respective light paths of the light from said light emitters, and arranged such that said detection points are positioned on an arc centered at the fulcrum of said hammer;

a board on which said plurality of detectors are mounted, wherein each of said plurality of detectors is placed in a respective case and wherein at least one of the cases is spaced from the board by a spacer such that at least two of said plurality of detectors are spaced from said board by different distances from said board; and hammer speed detecting means for detecting a pivot speed of said hammer in accordance with timings at which said shutter opens and closes the light paths of the light from said light emitters of said plurality of detectors when said hammer pivotally moves.

2. A speed detecting apparatus for a keyboard musical instrument comprising:

a pivotable key;

a hammer pivotably supported by a fulcrum and configured to pivotally move in association with a pivotal movement of said key;

a shutter integrally attached to said hammer;

a plurality of detectors arranged along a pivotal movement path of said shutter, each having a light emitter and a light receiver for receiving light emitted from said light emitter, arranged on one and the other sides of the pivotal movement path of said shutter, said detectors having detection points on respective light paths of the light from said light emitters;

a plurality of boards each having at least one of said plurality of detectors mounted thereon, wherein said plurality of boards are arranged at different angles from one another such that said detection points are positioned on an arc centered at the fulcrum of said hammer; and hammer speed detecting means for detecting a pivot speed of said hammer in accordance with timings at which said shutter opens and closes the light paths of the light from said light emitters of said plurality of detectors when said hammer pivotally moves.

3. A speed detecting apparatus for a keyboard musical instrument according to claim 2, wherein said plurality of boards are identical in configuration to one another.

4. A speed detecting apparatus for a keyboard musical instrument comprising:

a key pivotable about a fulcrum;

a shutter integrally attached to said key;

a plurality of detectors arranged along a pivotal movement path of said shutter, each having a light emitter and a light receiver for receiving light emitted from said light emitter, arranged on one and the other sides of the pivotal movement path of said shutter, said detectors having detection points on respective light paths of the light from said light emitters, and arranged such that said detection points are positioned on an arc centered at the fulcrum of said key;

a board on which said plurality of detectors are mounted, wherein each of said plurality of detectors is placed in a respective case and wherein at least one of the cases is spaced from the board by a spacer such that at least two of said plurality of detectors are spaced from said board by different distances from said board; and key speed detecting means for detecting a pivot speed of said key in accordance with timings at which said shutter opens and closes the light paths of the light from said light emitters of said plurality of detectors when said key pivotally moves.

5. A speed detecting apparatus for a keyboard musical instrument comprising:

a key pivotable about a fulcrum;

a shutter integrally attached to said key;

a plurality of detectors arranged along a pivotal movement path of said shutter, each having a light emitter and a light receiver for receiving light emitted from said light emitter, arranged on one and the other sides of the pivotal movement path of said shutter, said detectors having detection points on respective light paths of the light from said light emitters;

a plurality of boards each having at least one of said plurality of detectors mounted thereon, wherein said plurality of boards are arranged at different angles from one another such that said detection points are positioned on an arc centered at the fulcrum of said key; and key speed detecting means for detecting a pivot speed of said key in accordance with timings at which said shutter opens and closes the light paths of the light from said light emitters of said plurality of detectors when said key pivotally moves.

6. A speed detecting apparatus for a keyboard musical instrument according to claim 5, wherein said plurality of boards are identical in configuration to one another.

* * * * *